United States Patent [19]

Naaijer

[11] Patent Number: 4,640,995

[45] Date of Patent: Feb. 3, 1987

[54] DEVICE FOR SELECTIVELY CONNECTING BETWEEN PARALLEL PATHS AND A COMMON PATH

[75] Inventor: Geert J. Naaijer, Louviers, France

[73] Assignee: U.S. Philips Corporation, New York, N.Y.

[21] Appl. No.: 790,634

[22] Filed: Oct. 23, 1985

Related U.S. Application Data

[63] Continuation of Ser. No. 712,458, Mar. 15, 1985, abandoned, which is a continuation of Ser. No. 514,762, Jul. 18, 1983, abandoned.

[30] Foreign Application Priority Data

Jul. 16, 1982 [FR] France ..... 82 12445

[51] Int. Cl.[4] ..... H01H 21/78

[52] U.S. Cl. ..... 200/11 DA; 200/11 G

[58] Field of Search ..... 200/11 D, 11 DA, 11 G, 200/11 J, 11 K, 11 TW, 17 R, 18, 292; 361/298

[56] References Cited

U.S. PATENT DOCUMENTS

| | | | |
|---|---|---|---|
| 1,911,360 | 5/1933 | Gilling | 361/298 |
| 2,123,050 | 7/1938 | Johnson | 361/298 |
| 2,848,568 | 8/1958 | Berkeley et al. | 200/11 K |
| 3,089,923 | 6/1959 | Wright | 200/11 TW |
| 3,531,603 | 12/1968 | Ashman | 200/11 J |
| 3,566,049 | 2/1971 | Wright | 200/11 TW X |
| 4,379,955 | 4/1983 | Comerford | 200/11 DA |
| 4,390,757 | 6/1983 | Wiessner | 200/11 G |

*Primary Examiner*—J. R. Scott

*Attorney, Agent, or Firm*—David R. Treacy

[57] ABSTRACT

A connection member between a given number of n distinct parallel paths ($V_1$ to $V_n$) and a common path ($V_0$) comprises, for establishing the $2^n$ distinct combinations of connections between this common path and the n distinct paths, $2^{n-1}$ connection arms distributed along a circle around the central part of the member in $2^{n-1}$ positions among $2^n$ possible positions. The $2^{n-1}$ positions are chosen such that the successive switching steps along a circular path of this member establish successively each of these $2^n$ distinct combinations of possible connections between the common path and the n parallel paths.

11 Claims, 3 Drawing Figures

DEVICE FOR SELECTIVELY CONNECTING BETWEEN PARALLEL PATHS AND A COMMON PATH

This is a continuation of application Ser. No. 712,458, filed 3-15-85 now abandoned which is a continuation of 514,762, filed July 18, 1983, now abandoned.

BACKGROUND OF THE INVENTION

The invention relates to a connection device, having a connection member, for establishing connections between a given number n of parallel distinct paths and a common path; and especially to such a device for electrical connections. Such connection devices have, for example, application in the composition of security and station identification systems.

SUMMARY OF THE INVENTION

The invention has for its object to provide a connection device having a member, whose different positions can establish all the distinct combinations of connections between this common path and the n distinct paths, the number of these combinations being equal to $2^n$.

According to the invention, the connection member for establishing the $2^n$ distinct combinations of connections between this common path and the n distinct paths comprises $2^{n-1}$ connection arms distributed along a circle around the central part of the member in $2^{n-1}$ connection positions being chosen so that the successive orientations of this member to each of $2^n$ equally spaced angular positions establish successively each of the $2^n$ distinct combinations of possible connections between the common path and the n parallel paths.

BRIEF DESCRIPTION OF THE DRAWING

The invention will now be described more fully with reference to the accompanying drawings, in which.

DESCRIPTION OF THE PREFERRED EMBODIMENTS

Figure 1:
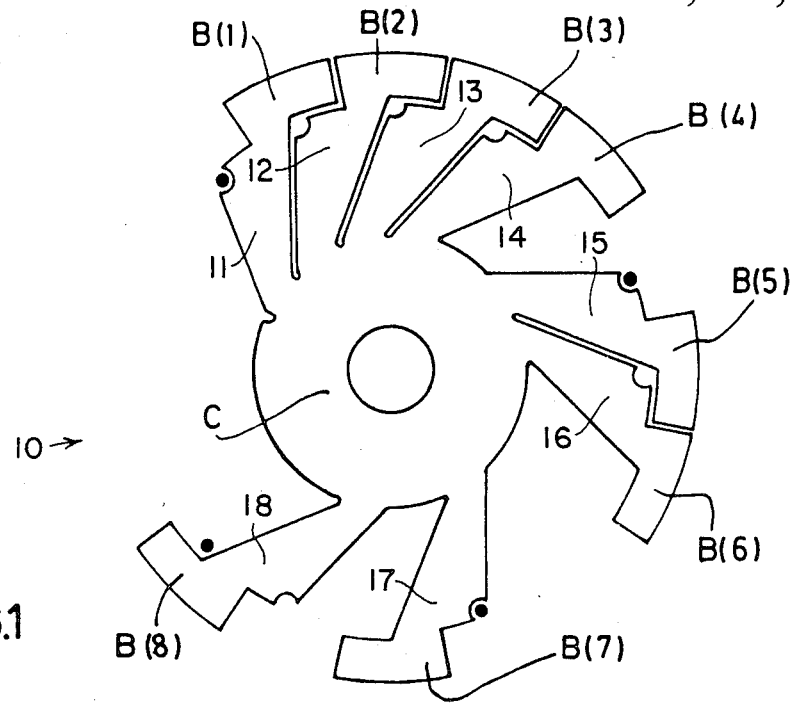
FIG. 1 is a schematic plan view of the connection member and abutment pins according to the invention for an embodiment in which the connections to be established or not to be established are electrical connections.

The connection members described with reference to these figures are in the present examples electrical contactors, but of course the connections to be established or not to be established may also be of another type without departing from the scope of the invention. The connection member 10 of FIG. 1 is designed for use with a preferred arrangement of connection locations $V_1$ to $V_4$ and locations on a common path $V_0$ shown on the base member 30 of FIG. 2. The member shown in the case in which n=4 consequently comprises for establishing the $2^4=16$ distinct combinations of electrical connections between a common path $V_o$ and four distinct parallel paths 31, 32, 33, 34 leading to locations $V_1$ to $V_4$ on the base member 30, $2^3=8$ connecting arms 21 to 28 extending to connection portions B(1) to B(8)

distributed along a circle around the central part C of the member in eight positions chosen among 16 possible positions.

The choice of the relative positions of the eight connection portions is made in the following manner. When it is assumed that the four parallel paths $V_1$ to $V_4$ on the contactor corresponding to four successive positions of the connection arms and when it is assumed that further the situations of the electrical connections between these four paths and the connection arms are designated in a usual manner by 1 and the situations of the absence of electrical connections by 0, it must be possible to have the following combinations available:

| | |
|---|---|
| (a) four connections on four: | |
| 1 1 1 1 | (1) |
| (b) three connections on four: | |
| 1 1 1 0 | (2) |
| 0 1 1 1 | (3) |
| 1 0 1 1 | (4) |
| 1 1 0 1 | (5) |
| (c) two connections on four: | |
| 1 1 0 0 | (6) |
| 0 1 1 0 | (7) |
| 0 0 1 1 | (8) |
| 1 0 0 1 | (9) |
| 1 0 1 0 | (10) |
| 0 1 0 1 | (11) |
| (d) one connection on four | |
| 0 0 0 1 | (12) |
| 0 0 1 0 | (13) |
| 0 1 0 0 | (14) |
| 1 0 0 0 | (15) |
| (e) no connection: | |
| 0 0 0 0 | (16) |

It is now found that these sixteen possible combinations are effectively obtained by displacing along a circle the contactor (which is assumed to be rotatable with respect to the paths which are assumed to be stationary) if these sixteen combinations succeed each other in the following order (taking into account the numeral assigned to each of them above):

(1) (2) (5) (4) (7) (6) (9) (13) (11) (10) (14)
(15) (16) (12) (8) (3) (1) (2) etc . . .

The following arrangement corresponds to this order:

```
1 1 1 1
 1 1 1 0
  1 1 0 1
   1 0 1 1
    0 1 1 0
     1 1 0 0
      1 0 0 1
       0 0 1 0
        0 1 0 1
         1 0 1 0
          0 1 0 0
           1 0 0 0
            0 0 0 0
             0 0 0 1
              0 0 1 1
                0 1 1 1
                 1 1 1 1
                 etc . . . ,
```

from which arrangement is derived at (17) the distribution of the connection arms B(1) to B(8) by causing the presence of an arm to correspond to 1 and the absence of an arm to 0:

| | |
|---|---|
| 1 1 1 1 0 1 1 0 0 1 0 1 0 0 0 0 | (17). |

Figure 2:
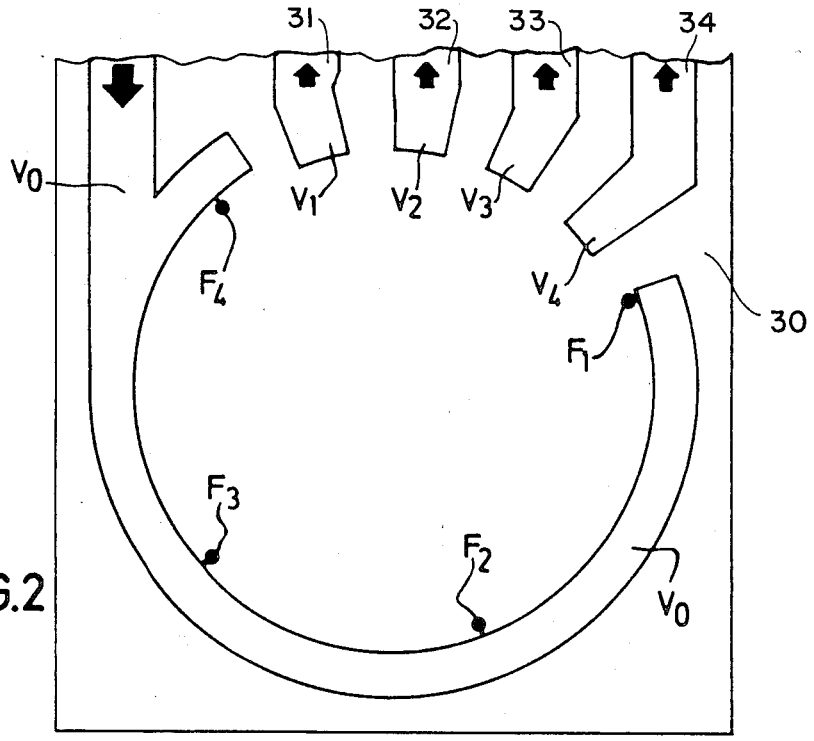
FIG. 2 is a schematic plan view of the electrical connections and abutment pins on a base member for use with the connection member shown in FIG. 1.

FIG. 1 shows the electrical contactor with sixteen possible positions, of which the eight positions of the connection portions B(1) to B(8) correspond to this sequence (17), while FIG. 2 shows the arrangement of the connection locations $V_0,V_1,V_2,V_3,V_4$ in the case in which the contactor of FIG. 1 is used. Paths 31–34 and common path $V_0$ are formed on, and mechanical abutment stops $F_1$ to $F_4$ are fixed to the base 30. The paths 31–34, which are electrically conducting, extend to the respective locations $V_1$ to $V_4$, and the common path $V_0$ extends to the various common path locations at which contact with the portions B(1) to B(8) are selectively made. One or more of the stops $F_1$ to $F_4$ engage the member or contactor 10 to fix it in the selected arbitrary position of the sixteen positions it has to occupy. As shown in FIG. 1, each arm may be generally L-shaped and may include a recess for cooperating with a respective abutment stop in order to fix the contactor in the one position. Further, the stops are distributed such that they can prevent rotation of the central part C in both the clockwise and counterclockwise directions.

It will be clear from the foregoing description and of the drawing that this preferred embodiment is not operated like a conventional rotary switch. The pin-like abutment stops $F_1$ to $F_4$ prevent rotation of the member 10 in either direction. Thus this embodiment permits setting a code, which may identify a particular station in a system, by lifting the member 10 free of the stops $F_1$–$F_4$ and rotating the member to the desired orientation, and then placing the connection member onto the base member so that the abutment stops keep the connection member from rotating out of this angular orientation.

Of course, the invention is not limited to the embodiment described above and shown here, of which modifications can be proposed without departing from the scope of the invention. Especially the oblique arrangement of the arms in FIG. 1 has only for its object to provide more favorable bending properties for the arms B(1) to B(8) for the formation of the contacts with the paths $V_0$ to $V_4$ and this arrangement could have been very simply a radial arrangement.

Figure 3:
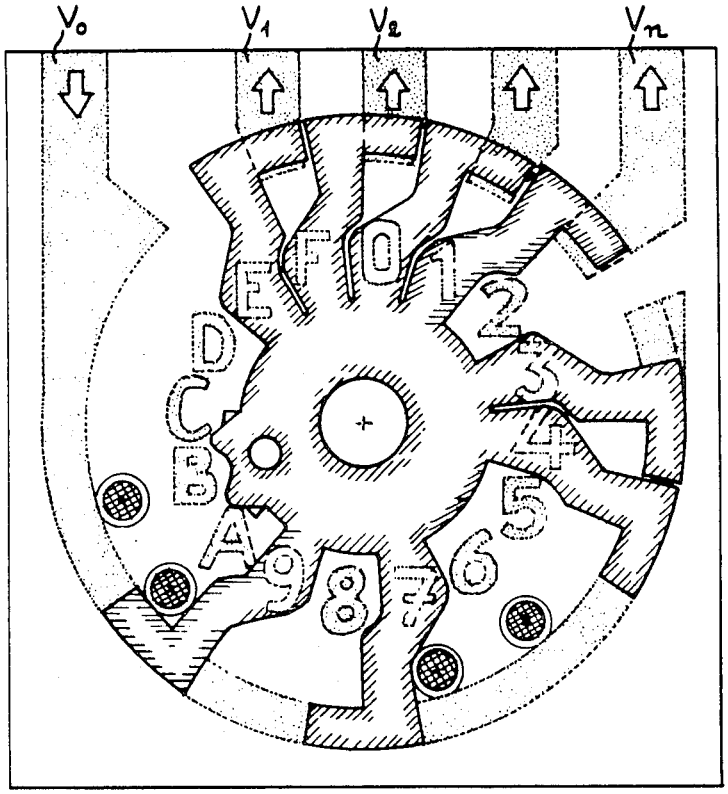
FIG. 3 is a plan view of another embodiment the superposition of the contactor of FIG. 1 and the connections of FIG. 2.

The position of the mechanical abutment stops shown in FIG. 2 is further not the only position that can be used. FIG. 3, which shows in a slightly different embodiment the superposition of the contactor according to the invention and the support of the paths $V_0$ to $V_4$, shows another possible position for these stops. Finally, FIGS. 1 and 3 show the path $V_0$ with a maximum length, but it is sufficient for the length of this path to be at least equal to the distance between two arm positions on the contactor separated by five sixteenth of a revolution. The length of the path $V_0$ may assume any arbitrary value between this minimum length and the maximum length shown.

What is claimed is:

1. A connection device comprising:

a base member having n connection locations and at least n+1 common path locations defined thereon, where n is greater than 2, said connection locations and common path locations being disposed at respective ones of $2^n$ equally spaced positions lying along a single circle only, concentric about a center, means for defining n paths along said base member, each path extending to a respective one of said connection locations, means for defining a common path along said base member, said common path extending to each of said common path locations, a connection member comprising path means for communicating between $2^{n-1}$ connection positions, each of said connection positions being arranged at a respective one of said $2^n$ equally spaced positions, and means disengagingly connecting said connection member to said base member for permitting said connection member to be oriented at a selected one of said $2^n$ equally spaced angular positions; said n connection locations being arranged with respect to each other, and said $2^{n-1}$ connection positions being arranged with respect to each other, such that each of said $2^n$ equally spaced angular positions establishes communication between said common path and a respective one of $2^n$ distinct combinations of possible connections with said n paths.

2. A device as claimed in claim 1, characterized in that said n connection locations are adjoining ones of said equally spaced positions.

3. A device as claimed in claim 1, characterized in that said means for disengagingly connecting comprises at least one abutment element rigidly fixed to one of said members.

4. A device as claimed in claim 3, characterized in that said abutment element is fixed to said base member, and said device includes a plurality of said abutment elements disposed at a same radius from said center, spaced at positions angularly separated by respective angles which are integral multiples of $\pi \times 2^{1-n}$ radians.

5. A device as claimed in claim 3, characterized in that said connection member comprises a central part and $2^{n-1}$ connecting arms extending from said central part to said $2^{n-1}$ connection positions, and each connecting arm has a recess formed therein, said recesses being disposed at approximately said same radius from said center, spaced at positions angularly separated by respective angles which are integral multiples of $\pi \times 2^{1-n}$ radians, arranged such that upon orientation of said connection member at a selected one of said $2^n$ equally spaced angular positions, at least one of said recesses engages at least one of said abutment elements.

6. A device as claimed in claim 5, characterized in that said connecting arms extend resiliently from said central part at an angle which is oblique with respect to a radial line, arranged such that said engagement causes a resilient deflection of each respectively engaged arm.

7. An electrical connection device comprising:

a base member having n connection locations and at least n+1 common path locations defined thereon, where n is greater than 2, said electrical contact surfaces at respective connection locations and electrical contact surfaces at respective common path locations being disposed at respective ones of $2^n$ equally spaced positions lying along a single circle only, concentric about a center, means for defining n paths along said base member, each path being formed by an electrically conductive material extending to a respective one of said connection locations, an electrically conductive strip defining a common path along said base member, said common path extending to each of said common path locations, a connection member comprising an electrically conductive material communicating between $2^{n-1}$ connection portions at respective connection positions, each of said connection positions being arranged at a respective one of said $2^n$ equally spaced positions, and means disengagingly connecting said connection member to said base member for permitting said connection member to be oriented at a selected one of said $2^n$ equally spaced angular positions; said n connection locations being arranged with respect to each other, and said $2^{n-1}$ connection positions being arranged with respect to each other, such that each of said $2^n$ equally spaced angular positions establishes communication between said common path and a respective one of $2^n$ distinct combinations of possible connections with said n paths.

8. A device as claimed in claim 7, characterized in that said n connection locations are adjoining ones of said equally spaced positions.

9. A device as claimed in claim 7, characterized in that said means for disengagingly connecting comprises at least one abutment element rigidly fixed to one of said members.

10. A device as claimed in claim 9, characterized in that said abutment element is fixed to said base member, and said device includes a plurality of said abutment elements disposed at a same radius from said center, spaced at positions angularly separated by respective angles which are integral multiples of $\pi \times 2^{1-n}$ radians.

11. A device as claimed in claim 10, characterized in that said connection member comprises a central part and $2^{n-1}$ connecting arms extending from said central part to said $2^{n-1}$ connection portions, and each connecting arm has a recess formed therein, said recesses being disposed at approximately said same radius from said center, spaced at positions angularly separated by respective angles which are integral multiples of $\pi \times 2^{1-n}$ radians, arranged such that upon orientation of said connection member at a selected one of said $2^n$ equally spaced angular positions, at least one of said recesses engages at least one of said abutment elements.

12. A device as claimed in claim 11, characterized in that said connecting arms extend resiliently from said central part at an angle which is oblique with respect to a radial line, arranged such that said engagement causes a resilient deflection of each respectively engaged arm.

13. An electrical connection device comprising:

a base member having n connection locations and n+1 common path locations defined thereon, where n is greater than 2, said electrical contact surfaces at respective connection locations and electrical contact surfaces at respective common path locations being disposed at respective ones of $2^n$ equally spaced positions lying along a single circle only, concentric about a center, said connection locations adjoining each other, and said common path locations adjoining each other, means for defining n paths along said base member, each path being formed by an electrically conductive material extending to a respective one of said connection locations, an electrically conductive strip defining a common path along said base member, said common path extending to each of said common path locations, a connection member comprising an electrically conductive material communicating between $2^{n-1}$ connection portions at respective connection positions, each of said connection positions being arranged at a respective one of said $2^n$ equally spaced positions, and means disengagingly connecting said connection member to said base member for permitting said connection member to be oriented at a selected one of said $2^n$ equally spaced angular positions, said n connection locations being arranged with respect to each other, and said $2^{n-1}$ connection positions being arranged with respect to each other, such that each of said $2^n$ equally spaced angular positions establishes communication between said common path and a respective one of $2^n$ distinct combinations of possible connections with said n paths.

14. A device as claimed in claim 13, characterized in that said connection member is an electrical contactor having a central part and $2^{n-1}$ connecting arms extending from said central part to said $2^{n-1}$ connection positions, each arm consisting of a generally L-shaped part connected to the central part, said L-shaped part having two limbs, one of said limbs extending in a circumferential direction about said central part.

15. A device as claimed in claim 14, characterized in that said common path locations are portions of a common path extending circumferentially about said center over an arc covering n+1 of said equally spaced angular positions.

16. A device as claimed in claim 14, characterized in that said means for disengagingly connecting comprises at least one abutment element rigidly fixed to one of said members.

17. A device as claimed in claim 16, characterized in that said abutment element is fixed to said base member, and said device includes a plurality of said abutment elements disposed at a same radius from said center, spaced at positions angularly separated by respective angles which are integral multiples of $\pi \times 2^{1-n}$ radians.

18. A device as claimed in claim 17, characterized in that each connecting arm has a recess formed therein, said recesses being disposed at approximately said same radius from said center, spaced at positions angularly separated by respective angles which are integral multiples of $\pi \times 2^{1-n}$ radians, arranged such that upon orientation of said connection member at a selected one of said $2^n$ equally spaced angular positions, at least one of said recesses engages at least one of said abutment elements.

19. A device as claimed in claim 18, characterized in that said connecting arms extend resiliently from said central part at an angle which is oblique with respect to a radial line, arranged such that said engagement causes a resilient deflection of each respectively engaged arm.

20. A device as claimed in claim 13, characterized in that said connection member comprises a central part and $2^{n-1}$ connecting arms extending from said central part to said $2^{n-1}$ connection positions, and each connecting arm has a recess formed therein, said recesses being disposed at approximately said same radius from said center, spaced at positions angularly separated by respective angles which are integral multiples of $\pi \times 2^{1-n}$ radians, arranged such that upon orientation of said connection member at a selected one of said $2^n$ equally spaced angular positions, at least one of said recesses engages at least one of said abutment elements.

* * * * *